US009149822B2

(12) United States Patent
Munn et al.

(10) Patent No.: US 9,149,822 B2
(45) Date of Patent: Oct. 6, 2015

(54) QUICK RELEASE MECHANISM FOR PAINT SPRAYER

(75) Inventors: Jamie S. Munn, Maitland (CA); Graeme Crawley, Newcastle Upon Tyne (GB); Suhu Zhou, Jinhua (CN); Genzhang Ye, Jinhua (CN)

(73) Assignee: BLACK & DECKER INC., Newark, DE (US)

( * ) Notice: Subject to any disclaimer, the term of this patent is extended or adjusted under 35 U.S.C. 154(b) by 437 days.

(21) Appl. No.: 12/947,952

(22) Filed: Nov. 17, 2010

(65) Prior Publication Data

US 2011/0174900 A1 Jul. 21, 2011

Related U.S. Application Data

(60) Provisional application No. 61/397,711, filed on Oct. 5, 2010, provisional application No. 61/261,953, filed on Nov. 17, 2009.

(51) Int. Cl.

| | |
|---|---|
| ***B05B 9/043*** | (2006.01) |
| ***B05B 9/08*** | (2006.01) |
| ***B05B 15/06*** | (2006.01) |
| *B05B 9/01* | (2006.01) |

(52) U.S. Cl.

CPC ..... *B05B 9/0861* (2013.01); *B05B 15/065* (2013.01); *B05B 9/01* (2013.01); *B05B 9/043* (2013.01); *B05B 15/06* (2013.01)

(58) Field of Classification Search

CPC .... B05B 9/085; B05B 9/0855; B05B 9/0861; B05B 9/01; B05B 9/043; B05B 15/06; B05B 15/065

USPC ..... 239/329, 331, 332, 333, 526, 600, 239/585.1–586

See application file for complete search history.

(56) References Cited

U.S. PATENT DOCUMENTS

| | | | |
|---|---|---|---|
| 1,799,143 | A | 4/1931 | Bailey |
| 1,807,490 | A | 5/1931 | Milner |

(Continued)

FOREIGN PATENT DOCUMENTS

| | | | |
|---|---|---|---|
| CN | 1150396 | A | 5/1997 |
| CN | 1640561 | A | 7/2005 |

(Continued)

OTHER PUBLICATIONS

PCT International Search Report and Written Opinion for International Appln. No. PCT/US2010/057042 dated Apr. 21, 2011, 12 pages.

PCT International Search Report and Written Opinion for International Appln. No. PCT/US2010/057033 dated Mar. 17, 2011, 8 pages.

(Continued)

*Primary Examiner* — Christopher Kim

(74) *Attorney, Agent, or Firm* — Stephen R. Valancius

(57) ABSTRACT

A sprayer generally includes a tool housing have a wet housing portion that disconnects from a dry housing portion. A solenoid motor is contained in the dry housing portion. An arm member is connected to the dry housing portion. The solenoid motor is operable to move the arm member relative to the dry housing portion. A spray nozzle is connected to a chamber member in the wet housing portion. A piston member extends from the wet housing portion and terminates with a tip portion operable to engage the arm member. A catch member is movably connected to the dry housing portion having an extended condition and a retracted condition. The catch member in the retracted condition is operable to release the wet housing portion from the dry housing portion and disconnect the piston member from the solenoid motor. The catch member in the extended condition is operable to lock the wet housing portion to the dry housing portion and keep the piston member engaged with the arm member.

17 Claims, 14 Drawing Sheets

(56) References Cited

U.S. PATENT DOCUMENTS

| | | | | |
|---|---|---|---|---|
| 1,919,233 | A | | 7/1933 | Lee |
| 2,098,014 | A | | 11/1937 | Polston |
| 2,105,681 | A | | 1/1938 | Armstrong |
| 2,455,240 | A | | 11/1948 | Dupler |
| 2,456,493 | A | | 12/1948 | Drane et al. |
| 2,540,357 | A | | 2/1951 | Stanley |
| 2,704,690 | A | * | 3/1955 | Eichenauer ..... 239/127 |
| 2,888,207 | A | | 5/1959 | Sykes |
| 3,191,869 | A | | 6/1965 | Gilmour |
| 3,428,291 | A | | 2/1969 | Callahan, Jr. et al. |
| 3,795,366 | A | | 3/1974 | McGhie et al. |
| 3,816,165 | A | | 6/1974 | Horvath et al. |
| RE29,055 | E | | 11/1976 | Wagner |
| 4,106,181 | A | | 8/1978 | Mattchen |
| 4,137,952 | A | | 2/1979 | Rendemonti |
| 4,228,957 | A | | 10/1980 | Davini |
| 4,245,784 | A | | 1/1981 | Garcin |
| 4,278,205 | A | | 7/1981 | Binoche |
| 4,349,947 | A | | 9/1982 | Rood |
| 4,365,745 | A | | 12/1982 | Beck |
| 4,433,799 | A | | 2/1984 | Corsette |
| 4,442,977 | A | | 4/1984 | Beiswenger et al. |
| 4,483,483 | A | | 11/1984 | Grime |
| 4,501,500 | A | | 2/1985 | Terrels |
| 4,537,357 | A | | 8/1985 | Culbertson et al. |
| 4,551,037 | A | | 11/1985 | Kille et al. |
| 4,569,366 | A | | 2/1986 | West et al. |
| 4,569,503 | A | | 2/1986 | Karr, Jr. |
| 4,692,049 | A | | 9/1987 | Engle |
| 4,693,423 | A | | 9/1987 | Roe et al. |
| 4,735,362 | A | | 4/1988 | Trautwein et al. |
| 4,804,144 | A | | 2/1989 | Denman |
| 4,811,904 | A | | 3/1989 | Ihmels et al. |
| 4,884,742 | A | | 12/1989 | Bekius et al. |
| 4,936,511 | A | | 6/1990 | Johnson et al. |
| 4,971,251 | A | | 11/1990 | Dobrick et al. |
| 4,993,596 | A | | 2/1991 | Brown |
| 5,009,367 | A | | 4/1991 | Nielsen |
| 5,033,552 | A | | 7/1991 | Hu |
| 5,056,717 | A | | 10/1991 | Koide |
| 5,057,342 | A | | 10/1991 | Hoy et al. |
| 5,060,869 | A | | 10/1991 | Bekius |
| 5,090,623 | A | | 2/1992 | Burns et al. |
| 5,119,992 | A | | 6/1992 | Grime |
| 5,141,156 | A | | 8/1992 | Hoy et al. |
| 5,217,168 | A | | 6/1993 | Svendsen |
| 5,281,782 | A | | 1/1994 | Conatser |
| 5,284,299 | A | | 2/1994 | Medlock |
| 5,395,051 | A | | 3/1995 | Anderson et al. |
| 5,609,302 | A | | 3/1997 | Smith |
| 5,630,552 | A | | 5/1997 | Anfindsen et al. |
| 5,687,913 | A | | 11/1997 | Robisch et al. |
| 5,706,856 | A | | 1/1998 | Lancaster |
| 5,716,007 | A | * | 2/1998 | Nottingham et al. ..... 239/332 |
| 5,779,157 | A | | 7/1998 | Robisch et al. |
| 5,803,367 | A | | 9/1998 | Heard et al. |
| 5,826,795 | A | | 10/1998 | Holland et al. |
| 5,836,517 | A | | 11/1998 | Burns et al. |
| 5,927,602 | A | | 7/1999 | Robisch et al. |
| 5,934,887 | A | | 8/1999 | Veit |
| 5,949,209 | A | | 9/1999 | Okamoto et al. |
| 5,992,690 | A | | 11/1999 | Tracy |
| 6,000,419 | A | | 12/1999 | Bernhard |
| 6,009,899 | A | | 1/2000 | Polutnik |
| 6,089,471 | A | | 7/2000 | Scholl |
| 6,106,742 | A | | 8/2000 | Argyropoulos et al. |
| 6,189,804 | B1 | | 2/2001 | Vetter et al. |
| 6,247,995 | B1 | | 6/2001 | Bryan |
| 6,263,980 | B1 | | 7/2001 | Wadge |
| 6,286,611 | B1 | | 9/2001 | Bone |
| 6,383,062 | B1 | | 5/2002 | Jou |
| 6,390,386 | B2 | | 5/2002 | Krohn et al. |
| 6,431,466 | B1 | | 8/2002 | Kitajima |
| 6,527,200 | B1 | | 3/2003 | Huang |
| 6,547,161 | B1 | | 4/2003 | Huang |
| 6,553,642 | B2 | | 4/2003 | Driessen |
| 6,623,561 | B2 | | 9/2003 | Vetter et al. |
| 6,631,855 | B2 | | 10/2003 | Huang |
| 6,675,911 | B2 | | 1/2004 | Driessen |
| 6,702,203 | B2 | | 3/2004 | Jou |
| 6,805,306 | B1 | | 10/2004 | Huang |
| 6,824,075 | B2 | | 11/2004 | Zimmermann |
| 6,874,702 | B2 | | 4/2005 | Turnbull |
| 6,971,590 | B2 | | 12/2005 | Blette et al. |
| 7,017,835 | B2 | | 3/2006 | Vetter et al. |
| 7,021,399 | B2 | | 4/2006 | Driessen |
| 7,032,839 | B2 | | 4/2006 | Blette et al. |
| 7,069,948 | B2 | | 7/2006 | Lovell |
| 7,121,299 | B2 | | 10/2006 | Lumello |
| 7,185,672 | B2 | | 3/2007 | Lovell |
| 7,201,336 | B2 | | 4/2007 | Blette et al. |
| 7,207,497 | B2 | | 4/2007 | Clark |
| 7,246,759 | B2 | | 7/2007 | Turnbull |
| 7,250,023 | B2 | | 7/2007 | Bai |
| 7,347,136 | B2 | | 3/2008 | Bruggeman et al. |
| 7,360,720 | B2 | | 4/2008 | Gohring et al. |
| 7,374,377 | B2 | | 5/2008 | Bauman |
| 7,431,223 | B2 | | 10/2008 | Gohring |
| 7,484,676 | B2 | | 2/2009 | Joseph et al. |
| 7,540,434 | B2 | | 6/2009 | Gohring et al. |
| 7,549,449 | B2 | | 6/2009 | Herre et al. |
| 7,857,242 | B2 | * | 12/2010 | Huang ..... 239/600 |
| 2002/0166905 | A1 | | 11/2002 | Huang |
| 2003/0201340 | A1 | | 10/2003 | Hanson |
| 2004/0164182 | A1 | | 8/2004 | Joseph et al. |
| 2005/0150521 | A1 | | 7/2005 | Jones et al. |
| 2005/0269425 | A1 | | 12/2005 | Gohring et al. |
| 2005/0279517 | A1 | | 12/2005 | Hoffman et al. |
| 2006/0005766 | A1 | | 1/2006 | Gorges et al. |
| 2006/0275555 | A1 | | 12/2006 | Colizza |
| 2007/0278787 | A1 | | 12/2007 | Jones et al. |
| 2008/0029619 | A1 | | 2/2008 | Gohring et al. |
| 2008/0217442 | A1 | | 9/2008 | Anfindsen et al. |
| 2008/0226407 | A1 | | 9/2008 | Bauman |
| 2008/0296409 | A1 | | 12/2008 | Micheli |
| 2009/0145980 | A1 | | 6/2009 | Jones |
| 2009/0230218 | A1 | | 9/2009 | Drozd |
| 2009/0277976 | A1 | | 11/2009 | Micheli et al. |
| 2009/0302133 | A1 | | 12/2009 | Micheli et al. |
| 2010/0163654 | A1 | | 7/2010 | Bass et al. |

FOREIGN PATENT DOCUMENTS

| | | | |
|---|---|---|---|
| CN | 1706557 | A | 12/2005 |
| CN | 101081383 | A | 12/2007 |
| CN | 101125317 | A | 2/2008 |
| DE | 8713954 | U1 | 12/1987 |
| DE | 202007003070 | U1 | 7/2008 |
| DE | 202008009203 | U1 | 9/2008 |
| EP | 0513626 | A1 | 11/1992 |
| GB | 290866 | A | 5/1928 |
| GB | 2063424 | A | 6/1981 |
| JP | 63-020965 | U | 2/1988 |
| JP | 5212323 | A | 8/1993 |
| JP | 10507249 | T | 7/1998 |
| JP | 10510209 | T | 10/1998 |
| JP | 2003088781 | A | 3/2003 |
| WO | WO-9617689 | A1 | 6/1996 |
| WO | WO-9809073 | A1 | 3/1998 |
| WO | 02072276 | A1 | 9/2002 |
| WO | WO-2004025123 | A1 | 3/2004 |
| WO | WO-2006087055 | A1 | 8/2006 |
| WO | WO-2010047800 | A2 | 4/2010 |

OTHER PUBLICATIONS

PCT International Search Report and Written Opinion for International Appln. No. PCT/US2010/057041 dated Mar. 17, 2011, 10 pages.

PCT International Search Report and Written Opinion for International Appln. No. PCT/US2010/057050 dated Mar. 14, 2011, 8 pages.

* cited by examiner 16
80
90
90
76
184
102
122
126
124
128
106
120
66
110
78
104
112
108
100
188b
70
74
50
10
136
142
132
142
150
42
130
140
134
40
188a
18

QUICK RELEASE MECHANISM FOR PAINT SPRAYER

CROSS-REFERENCE TO RELATED APPLICATIONS

This application claims the benefit of U.S. Provisional Application No. 61/261,953, filed on Nov. 17, 2009. This application also claims the benefit of U.S. patent application Ser. No. 12/898,535, filed on Oct. 5, 2010, which has been converted to U.S. Provisional Application No. 61/397,711 on Dec. 23, 2010. The entire disclosure of the above applications are incorporated herein by reference.

FIELD

The present disclosure relates to a sprayer for spraying fluids including paints and stains, and specifically relates to a sprayer having a housing where a wet side can be disconnected from a dry side with a quick release mechanism.

BACKGROUND

Typically, when changing paint in a paint sprayer, a reservoir of paint is emptied and cleaned before different paint is introduced. Cleaning the reservoir can expose the sprayer body and pump to the cleaning process. In certain examples where portions of the housing detach with the reservoir, the process to separate the housings can be relatively complex and require two hands to perform.

SUMMARY

This section provides a general summary of the disclosure, and is not a comprehensive disclosure of its full scope or all of its features.

The present teachings generally include a sprayer that includes a tool housing have a wet housing portion that disconnects from a dry housing portion. A solenoid motor is contained in the dry housing portion. An arm member is connected to the dry housing portion. The solenoid motor is operable to move the arm member relative to the dry housing portion. A spray nozzle is connected to a chamber member in the wet housing portion. A piston member extends from the wet housing portion and terminates with a tip portion operable to engage the arm member. A catch member is movably connected to the dry housing portion having an extended condition and a retracted condition. The catch member in the retracted condition is operable to release the wet housing portion from the dry housing portion and disconnect the piston member from the solenoid motor. The catch member in the extended condition is operable to lock the wet housing portion to the dry housing portion and keep the piston member engaged with the arm member.

Further areas of applicability will become apparent from the description provided herein. The description and specific examples in this summary are intended for purposes of illustration only and are not intended to limit the scope of the present teachings.

DRAWINGS

The drawings described herein are for illustrative purposes only of selected aspects of the present teachings and not all possible implementations, and are not intended to limit the scope of the present teachings.

Corresponding reference numerals indicate corresponding parts throughout the several views of the drawings.

DETAILED DESCRIPTION

Example aspects of the present teachings will now be described more fully with reference to the accompanying drawings.

Figure 1:
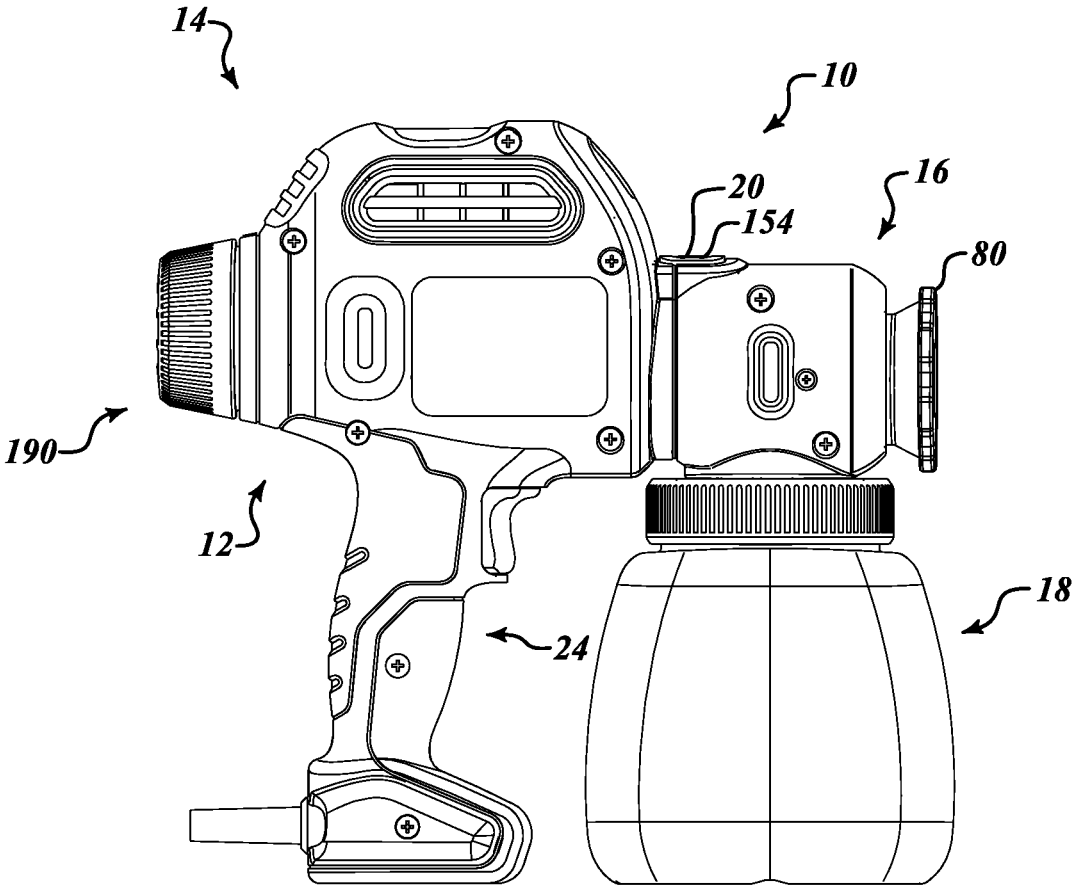
FIG. 1 is a side view of an exemplary sprayer constructed in accordance with the present teachings.

With reference to FIG. 1 of the drawings, a sprayer constructed in accordance with the present teachings is generally indicated by reference numeral 10. The sprayer 10 can have a tool housing 12 including a dry housing portion 14 and a wet housing portion 16. The wet housing portion 16 can be disconnected from the dry housing portion 14. A reservoir body 18 can connect to and disconnect from the wet housing portion 16.

Figure 2:
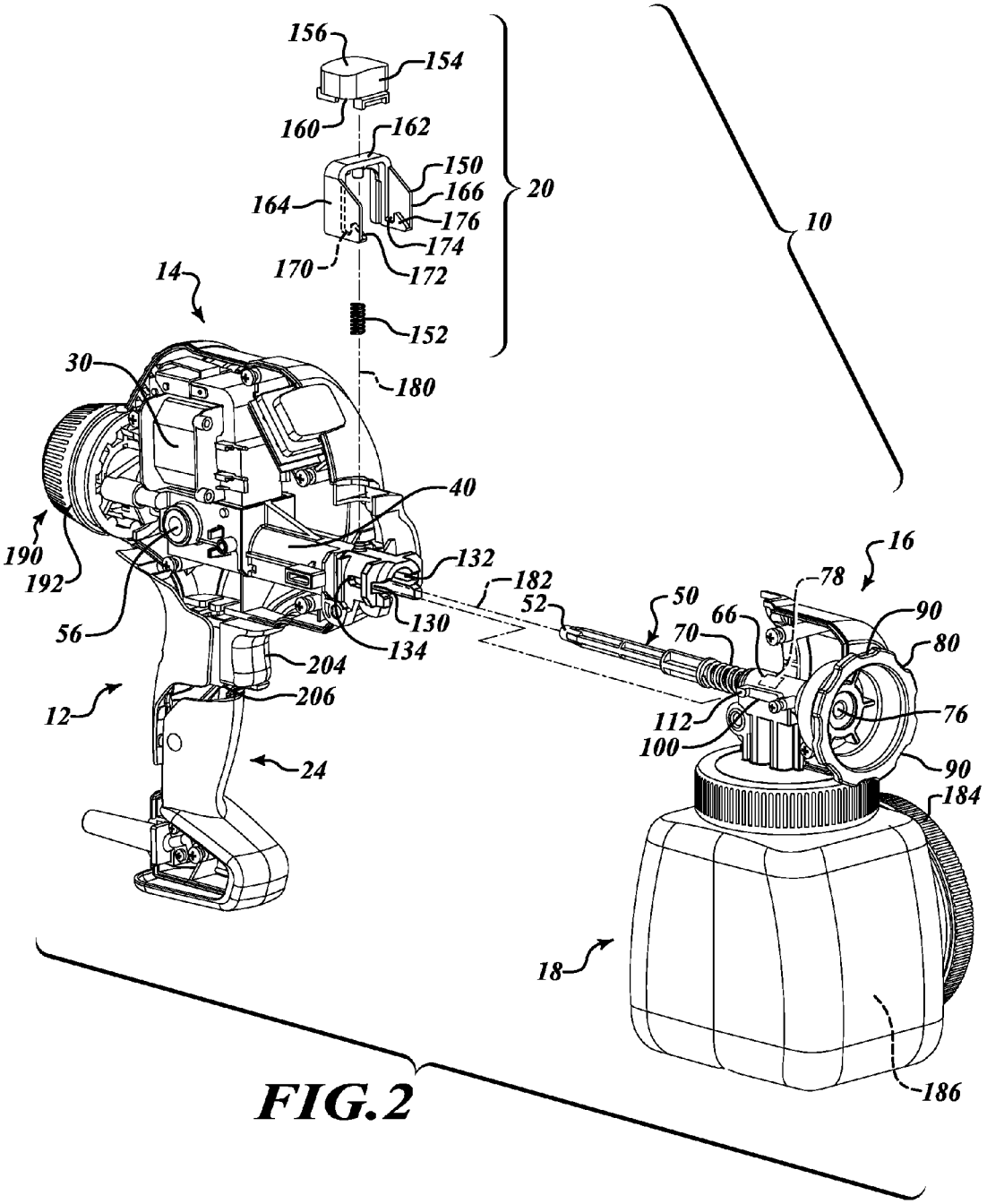
FIG. 2 is a partial exploded cross-sectional perspective view of the sprayer of FIG. 1 illustrating a housing of the sprayer where a wet housing portion is separated from a dry housing portion in accordance with the present teachings.
Figure 3:
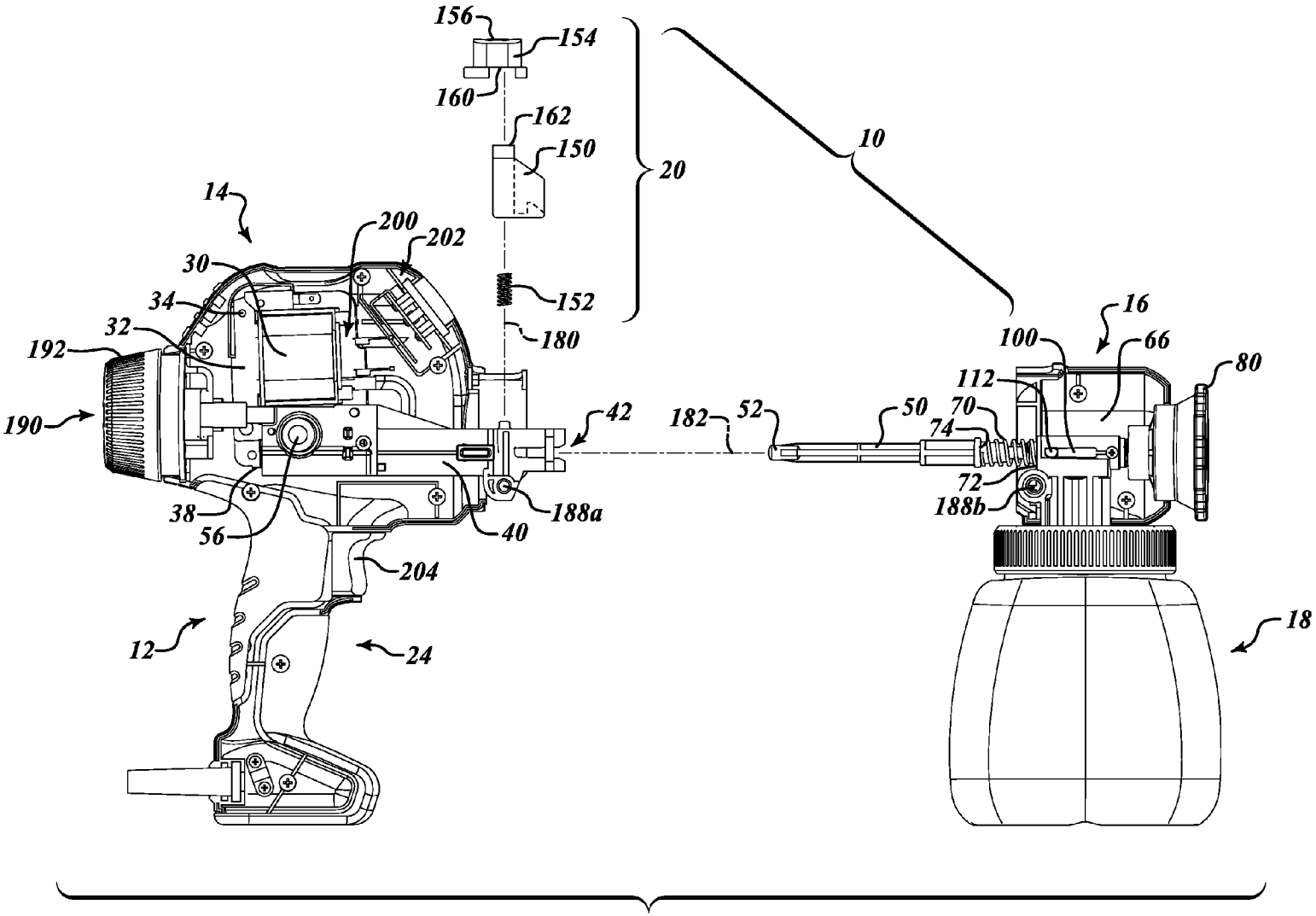
FIG. 3 is similar to FIG. 2 and shows a partial cross-sectional side view.

With reference to FIGS. 1, 2, and 3, the dry housing portion 14 can include a catch member 20 that is configured to permit the wet and dry housing portions 14, 16 to be locked to and uncoupled from one another. The dry housing portion can be formed of a pair of clam shell housing halves, and can define a housing body 22 and a handle 24. The wet housing portion 16 can also be formed of a pair of clam shell housing halves.

With reference to FIGS. 2, 3, 4, and 5, a solenoid motor 30 can be contained in the dry housing portion 14. In this example, the solenoid motor 30 can include an armature that can reciprocate to drive an arm member 32. The arm member 32 can pivot about a pin member 34. The arm member 32 can have an engagement portion 36. The engagement portion 36 on the arm member 32 can be disposed at an aperture 38 in a channel member 40 that can be connected to the dry housing portion 14. The channel member 40 can extend toward the wet housing portion 16 and can facilitate connection of the wet housing portion 16 with the dry housing portion 14. The channel member 40 can be disposed in the dry housing portion 14 and can be adjacent to the solenoid motor 30. The channel member 40 can have a receiving aperture 42 opposite the aperture 38 (FIG. 3) that can accept a piston member 50 that extends from the wet housing portion 16.

With reference to FIGS. 3, 4, 5, and 6, the wet housing portion 16 can include the piston member 50 that can extend toward the dry housing portion 14. The piston member 50 can include a tip portion 52. The tip portion 52 can extend through the channel member 40 on the dry housing portion 14 and can connect with the engagement portion 36 on the arm member 32. In doing so, the solenoid motor 30 can be engaged with the piston member 50 and when the solenoid motor 30 is initiated it can cause the reciprocation of the piston member 50.

Figure 12:
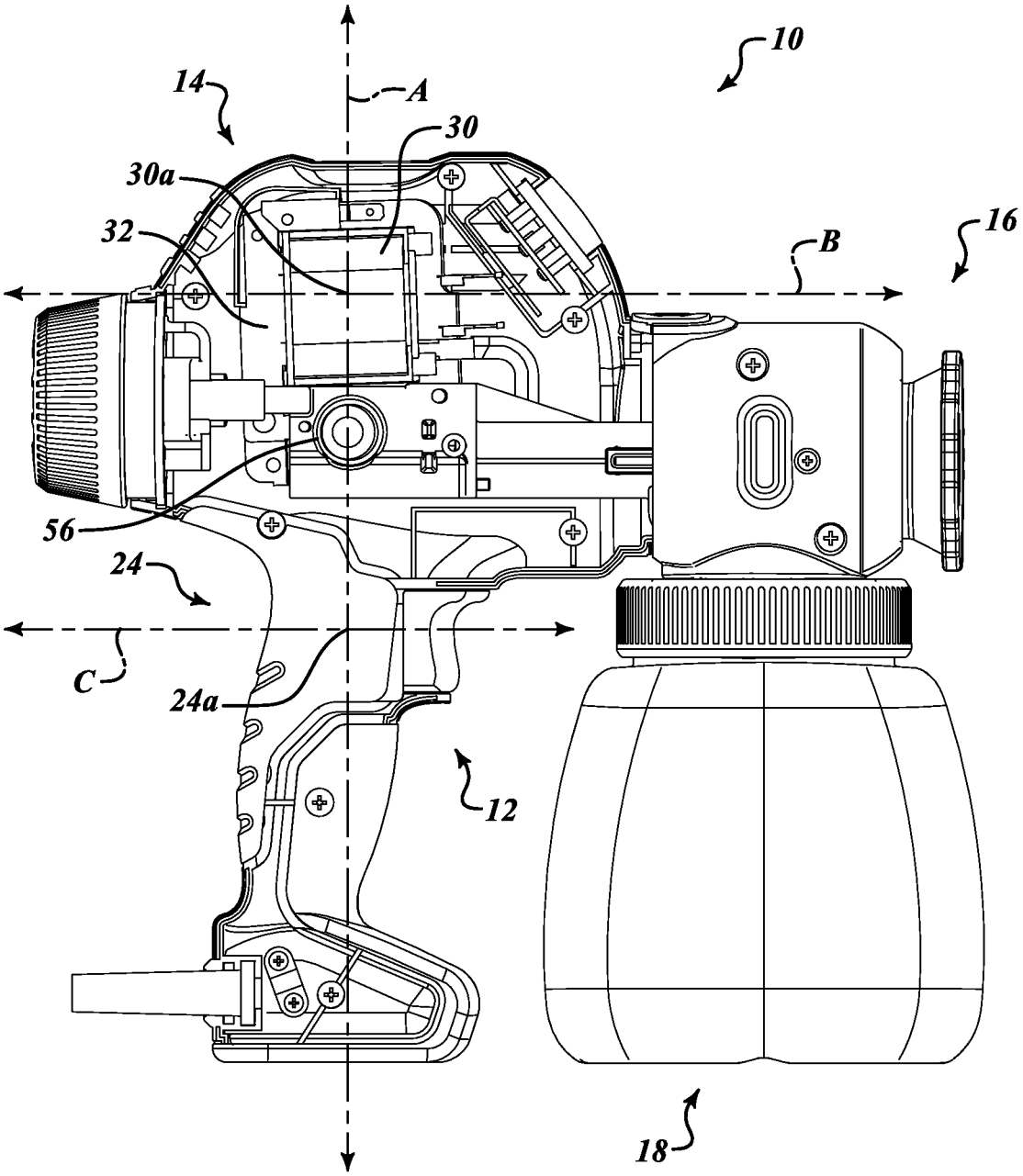
FIG. 12 is a partial cross-sectional side view of the sprayer of FIG. 1 showing a position of the solenoid motor relative to the handle that can be shown to improve balance of the sprayer in accordance with the present teachings.

With reference to FIG. 12, a center of mass of the solenoid motor 30 is indicated by reference numeral 30*a* at an intersection of axes A and B and a center balance point of the handle 24 is indicated by reference numeral 24*a* at an intersection of axes A and C. The center of mass 30*a* of the solenoid motor 30 can be configured to be in line with the center balance point 24*a* of the handle 24, i.e., arranged on axis A. In this manner, the balance of the sprayer 10 can be improved, which can be shown to increase comfort of a user during operation of the sprayer 10. Furthermore, a support casting isolator 56 can be coupled to the channel member 40 and the solenoid motor 30 and can be shown to reduce vibration of the sprayer 10 during operation. Arrangement of the support casting isolator 56 along the axis A can also be shown to reduce vibration of the solenoid motor 30 during operation of the sprayer 10.

Figure 13:
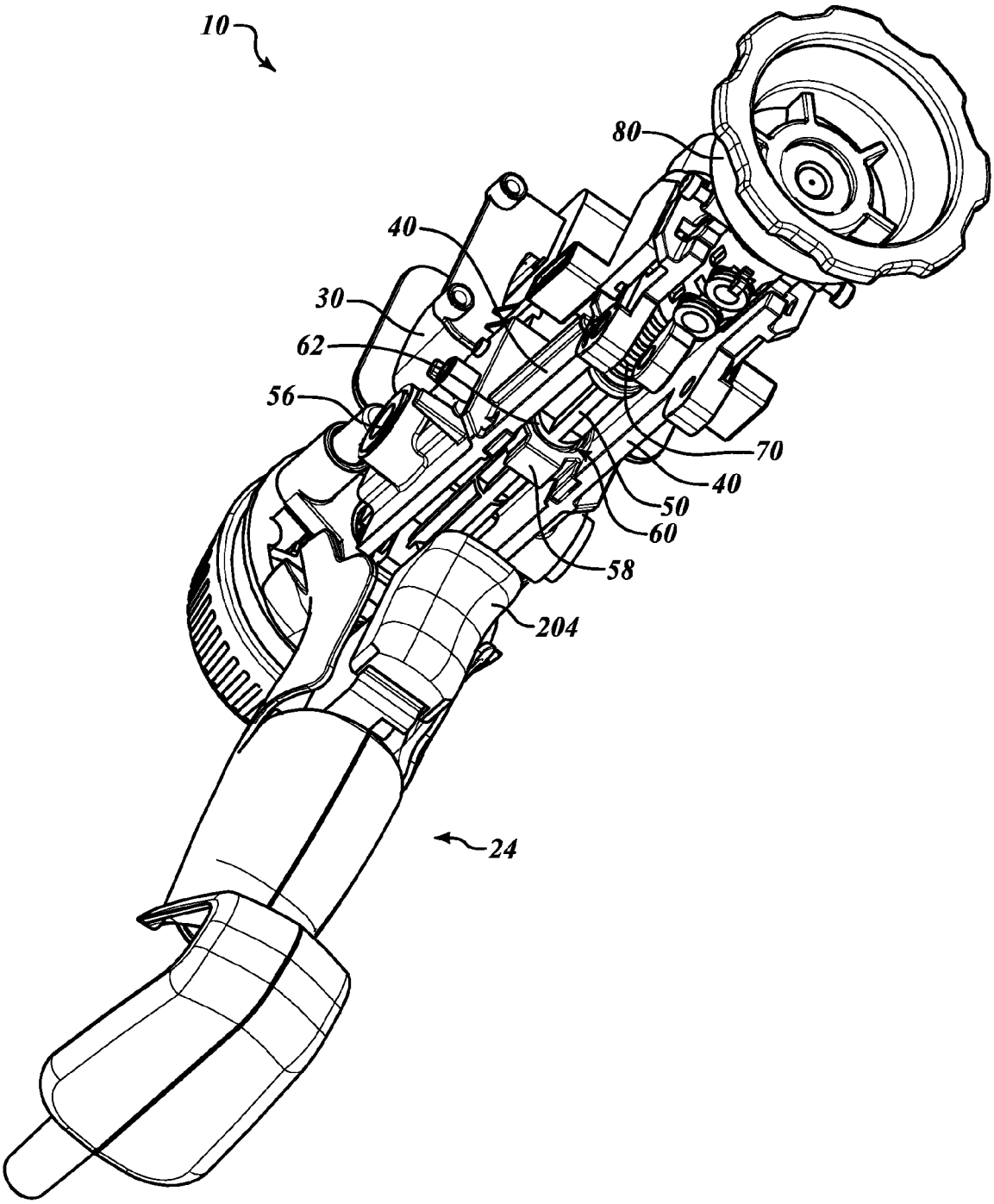
FIG. 13 is a partial cross-sectional perspective view of the sprayer of FIG. 1 and shows a supporting boss that receives the piston member and supports it during reciprocation in accordance with the present teachings.
Figure 14:
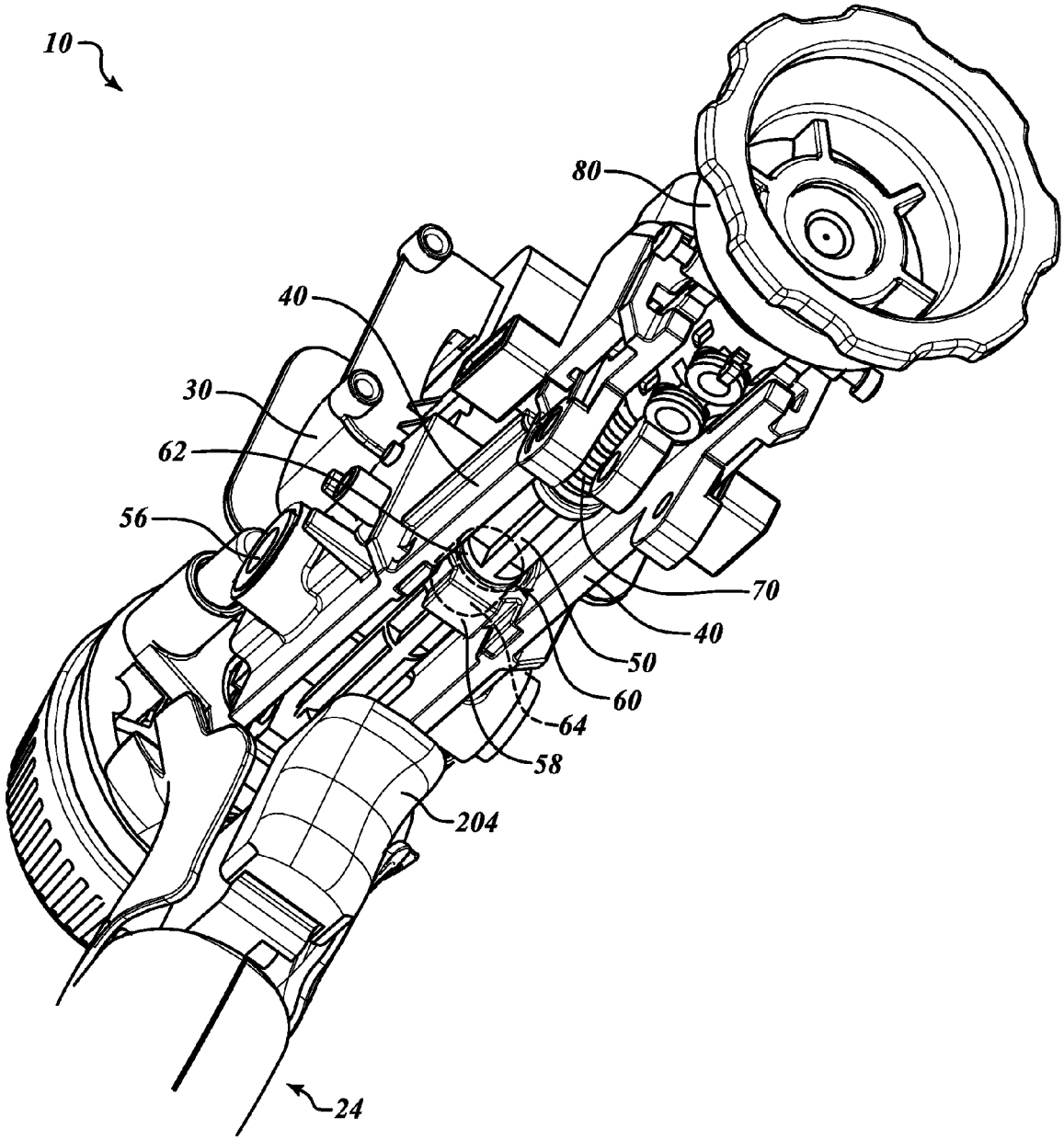
FIG. 14 is similar to FIG. 13 and shows a recessed sleeve in the piston member to slidingly engage a supporting boss sleeve in the supporting boss located in the channel member that is constructed in accordance with the present teachings.

In certain examples, the positioning of the center of mass 30*a* of the solenoid motor 30 to be in line with the center balance point 24*a* of the handle 24 can result in an increased length of the piston member 50. The piston member 50 can reciprocate with the channel member 40 as the sprayer 10 operates. As the length of the piston member 50 increases, however, the bending stress exerted on the piston member 50 can also increase. With reference to FIGS. 13 and 14, a supporting boss 58 can be arranged within the channel member 40 in order to reduce the propensity of the piston member 50 bending while reciprocating in the channel member 40. The supporting boss 58 can define a supporting boss aperture 60 in which the piston member 50 is received. The supporting boss 58 can provide support to, and can be shown to inhibit bending of, the piston member 50 during operation of the sprayer 10.

During operation of the sprayer 10, heat can be generated due to the friction between the piston member 50 and the supporting boss 58 as the piston member 50 reciprocates within the supporting boss aperture 60 of the supporting boss 58. In order to among other things reduce the heat generated, the supporting boss 58 can be formed of a material having a low coefficient of friction such as Teflon™ manufactured by E.I. Du Pont de Nemours & Company.

Additionally or alternatively, a supporting boss sleeve 62 having a low coefficient of friction can be arranged within the supporting boss aperture 60, as shown in FIG. 14. In another example, the piston member 50 can include a band member 64 that can be positioned on the piston member 50 to slidingly engage the supporting boss sleeve 62 on the supporting boss 58. The band member 64 can be an annular unitary structure or made from a multi-piece construction. The band member 64 can be recessed in the piston member 50 so as to be flush (or almost flush) with an outer periphery of the piston member 50. The supporting boss sleeve 62 or the band member 64 or both can be formed of a material having a low coefficient of friction such as Teflon™.

Figure 9:
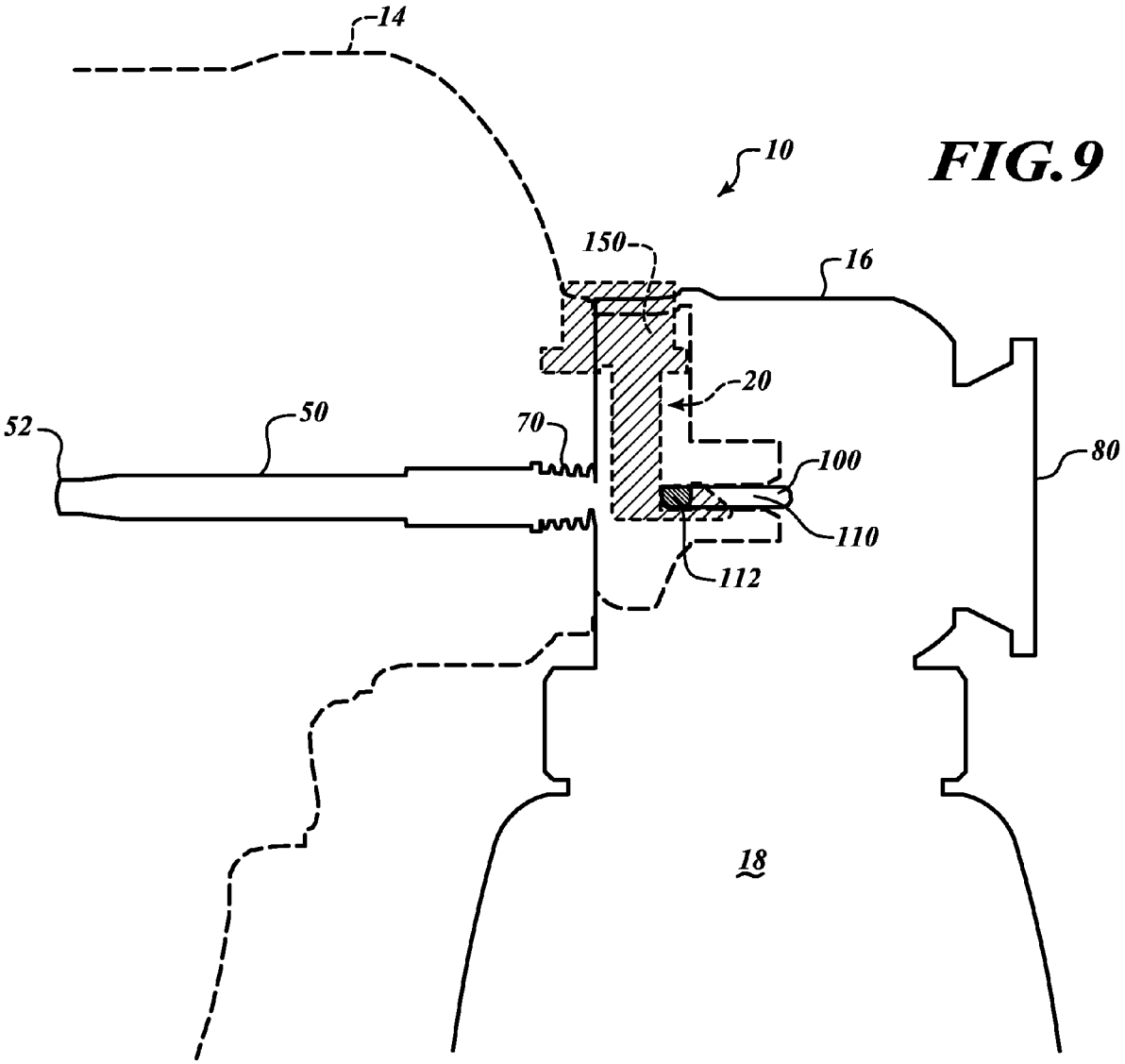
FIG. 9 is a diagram of the sprayer of FIG. 1 showing a catch member in an extended condition that locks the wet housing portion to the dry housing portion in accordance with the present teachings.
Figure 11:
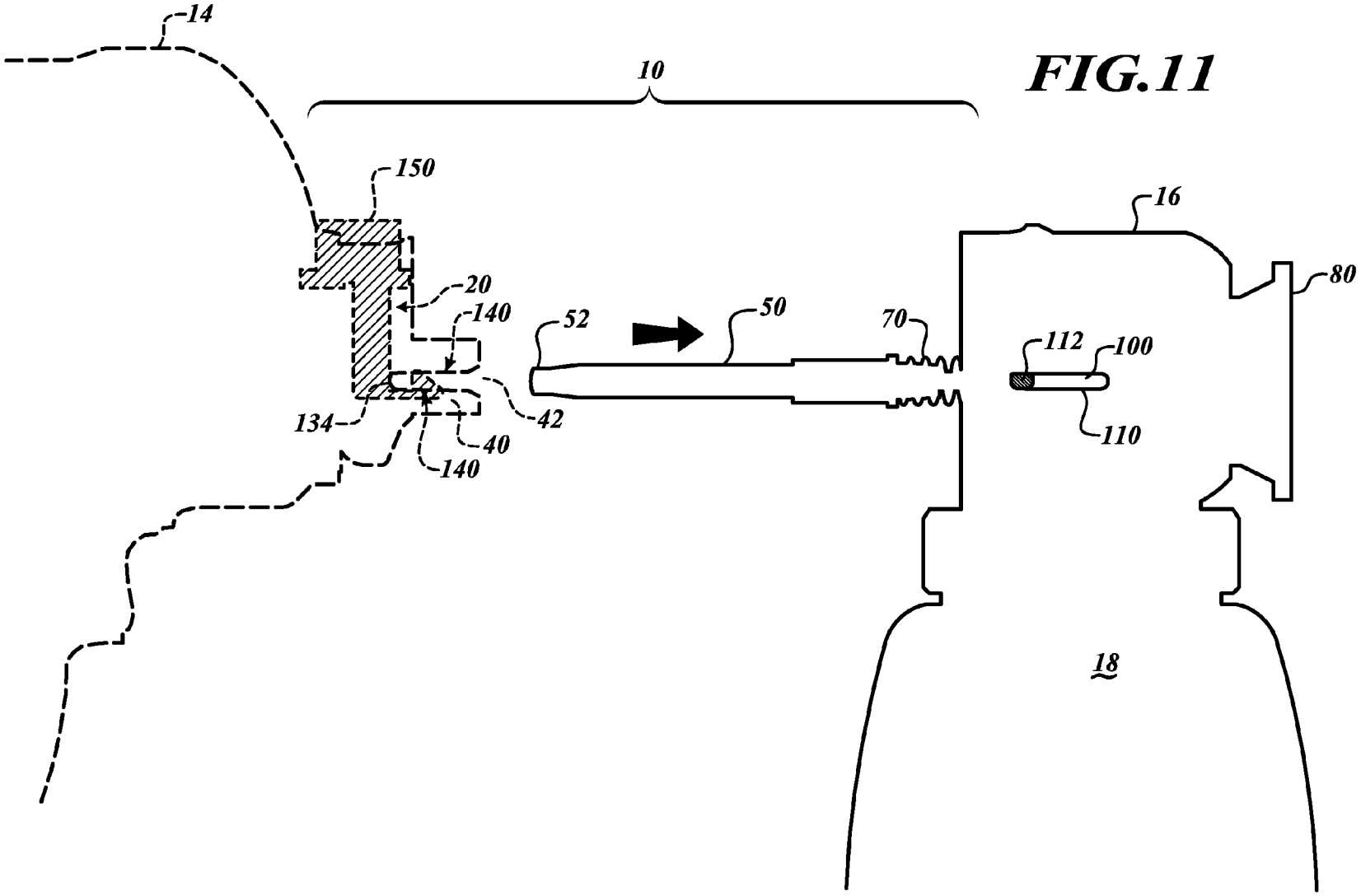
FIG. 11 is a diagram similar to FIG. 9 and shows the wet housing portion released from the dry housing portion and the piston member in the extended condition in accordance with the present teachings.

With reference to FIGS. 2, 3, 4, and 5, the piston member 50 can extend from and can connect to a chamber member 66 in the wet housing portion 16. An elastic member 70 can be disposed between a surface 72 formed on the chamber member 66 and a surface 74 formed on the piston member 50. The elastic member 70 can urge the tip portion 52 of the piston member 50 away from the chamber member 66 and into an extended condition. In this regard, the piston member 50 can reciprocate against the elastic member 70 and relative to the chamber member 66 between a retracted condition (FIG. 9) and the extended condition (FIG. 11). When the piston member 50 reciprocates, paint can be pumped out of the reservoir body 18 and into the chamber member 66. From the chamber member 66, the piston member 50 can pump the paint out of a spray nozzle 76. In doing so, the piston member 50 can actuate a pump 78 in the chamber member 66. In one example, the pump 78 can operate in a positive displacement fashion to pump paint from the reservoir body 18 to the spray nozzle 76.

When the wet housing portion 16 is locked to the dry housing portion 14 and the tip portion 52 of the piston member 50 is engaged with the engagement portion 36 on the arm member 32, the elastic member 70 can be in the retracted condition and further compressed between the chamber member 66 and the piston member 50. When the wet housing portion 16 is released from the dry housing portion 14, the elastic member 70 can urge the surfaces 72, 74 further apart to increase the spacing between the chamber member 66 and the tip portion 52 of the piston member 50.

The wet housing portion 16 can have a guard member 80 that can hold the spray nozzle 76, which can be fluidly connected to the chamber member 66 on a side opposite of the piston member 50. The spray nozzle 76 can include an orifice portion from which the paint can be directed out of the chamber member 66 and on to a workpiece. The spray nozzle 76 and the orifice portion can be fluidly connected to the chamber member 66 and can deliver a spray of paint in a pattern. The orifice portion can be a separate component from the spray nozzle 76, so that the spray nozzle 76 can rotate relative to the orifice portion. The orifice portion can atomize the paint and the spray nozzle 76 can impart the pattern. In other examples, a single component can atomize the paint and can impart the pattern on the spray of paint.

The guard member 80 can be disposed around the spray nozzle 76 and can have a multitude of finger depressions 90. The multitude of finger depressions 90 can be used to rotate the guard member 80 that is fixed for rotation with the spray nozzle 76. By rotating the guard member 80, the rotation of the spray nozzle 76 can provide different orientations of the pattern of the spray that is emitted from the spray nozzle 76. In one example, the spray nozzle 76 can produce a flat, planar spray pattern. By rotating the guard member 80, the plane of the spray pattern can be rotated. In doing so, it can be shown that the paint can be more easily directed in more specific and relatively harder to reach locations.

Figure 4:
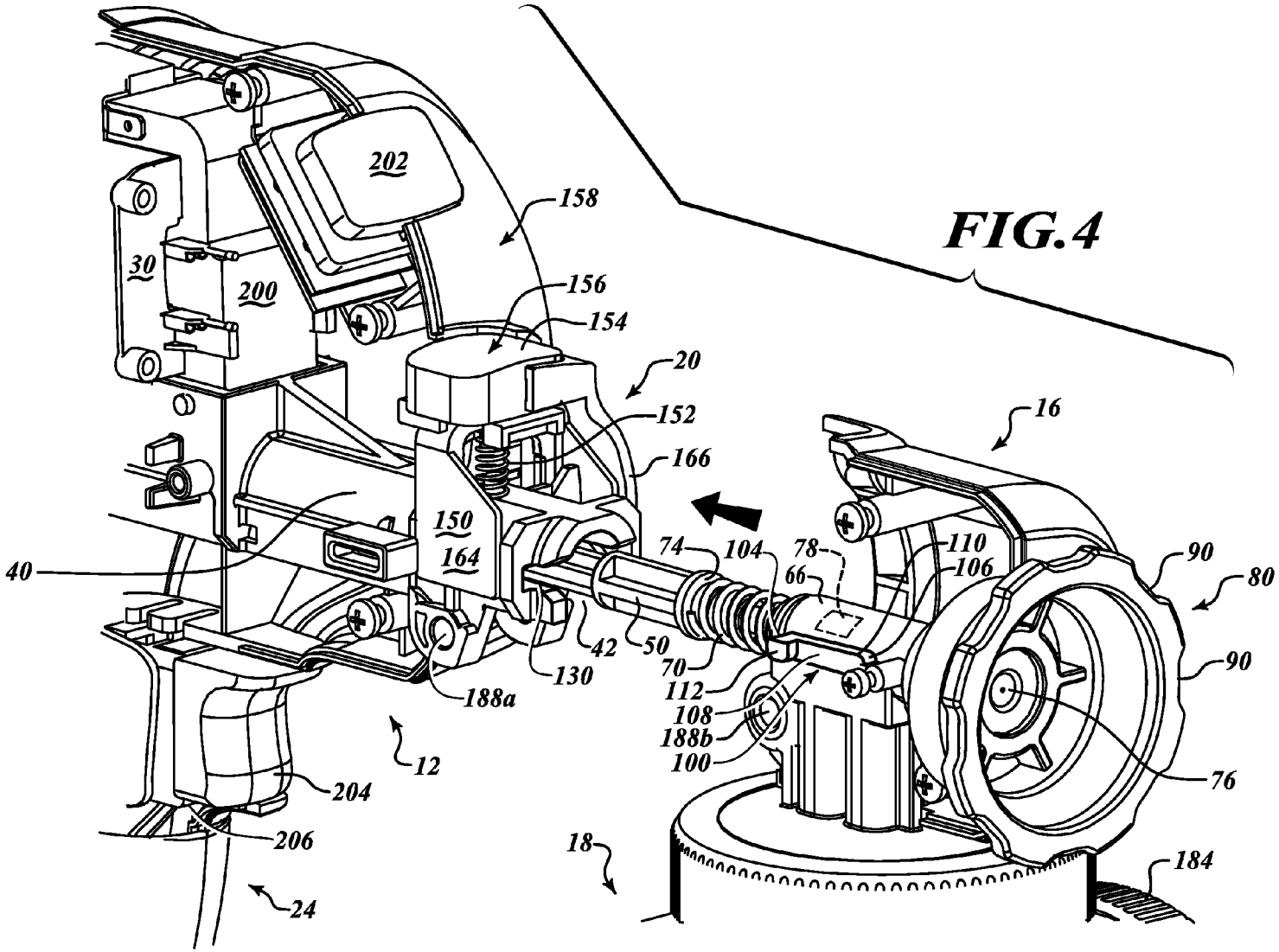
FIG. 4 is a partial cross-sectional perspective view of the sprayer of FIG. 1 illustrating a piston member of the wet housing portion inserted in a channel member on the dry housing portion in accordance with the present teachings.
Figure 5:
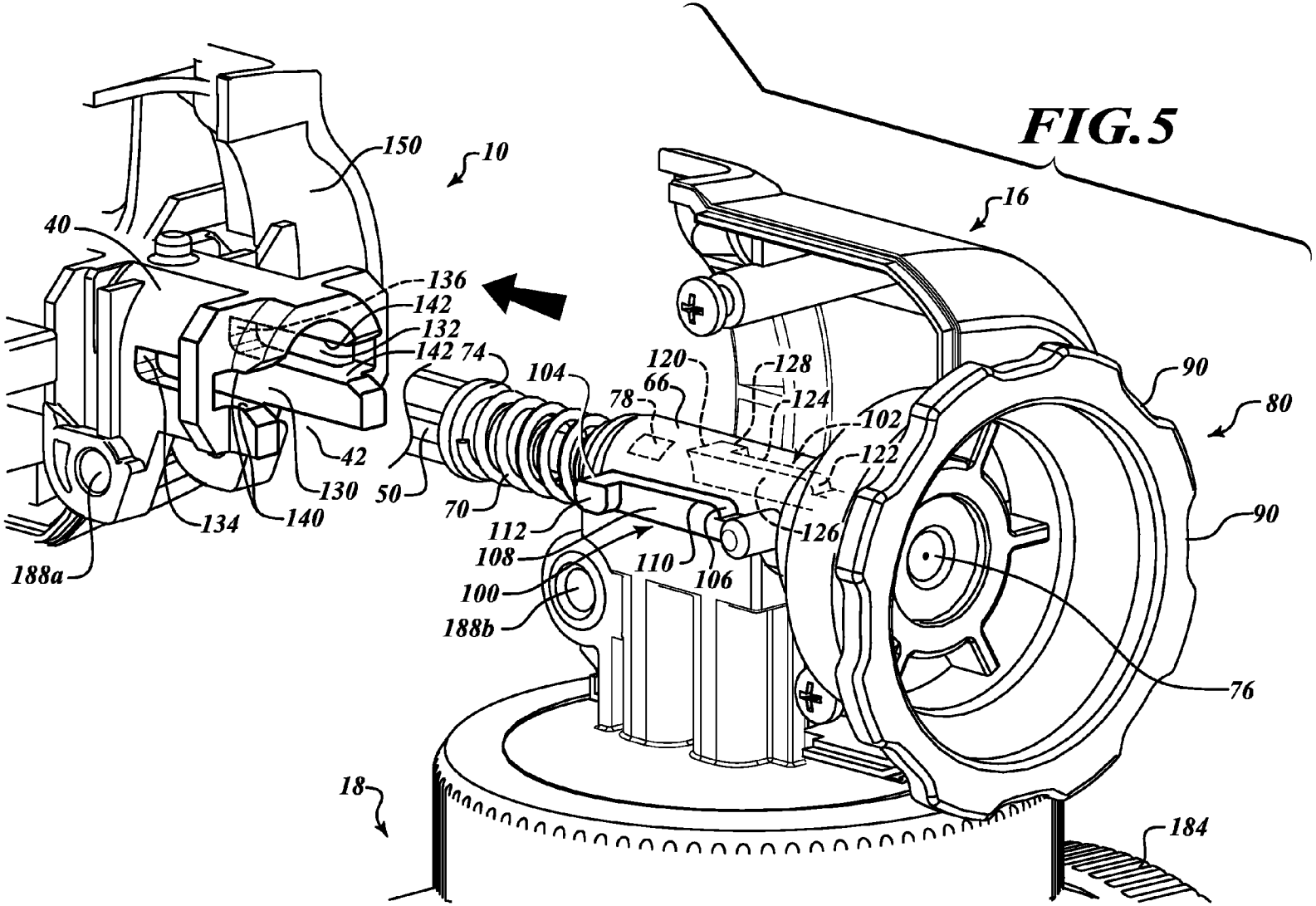
FIG. 5 is similar to FIG. 4 and shows protrusions with wing members and post members on opposite sides of the chamber member that connect to the channel member constructed in accordance with the present teachings.
Figure 6:
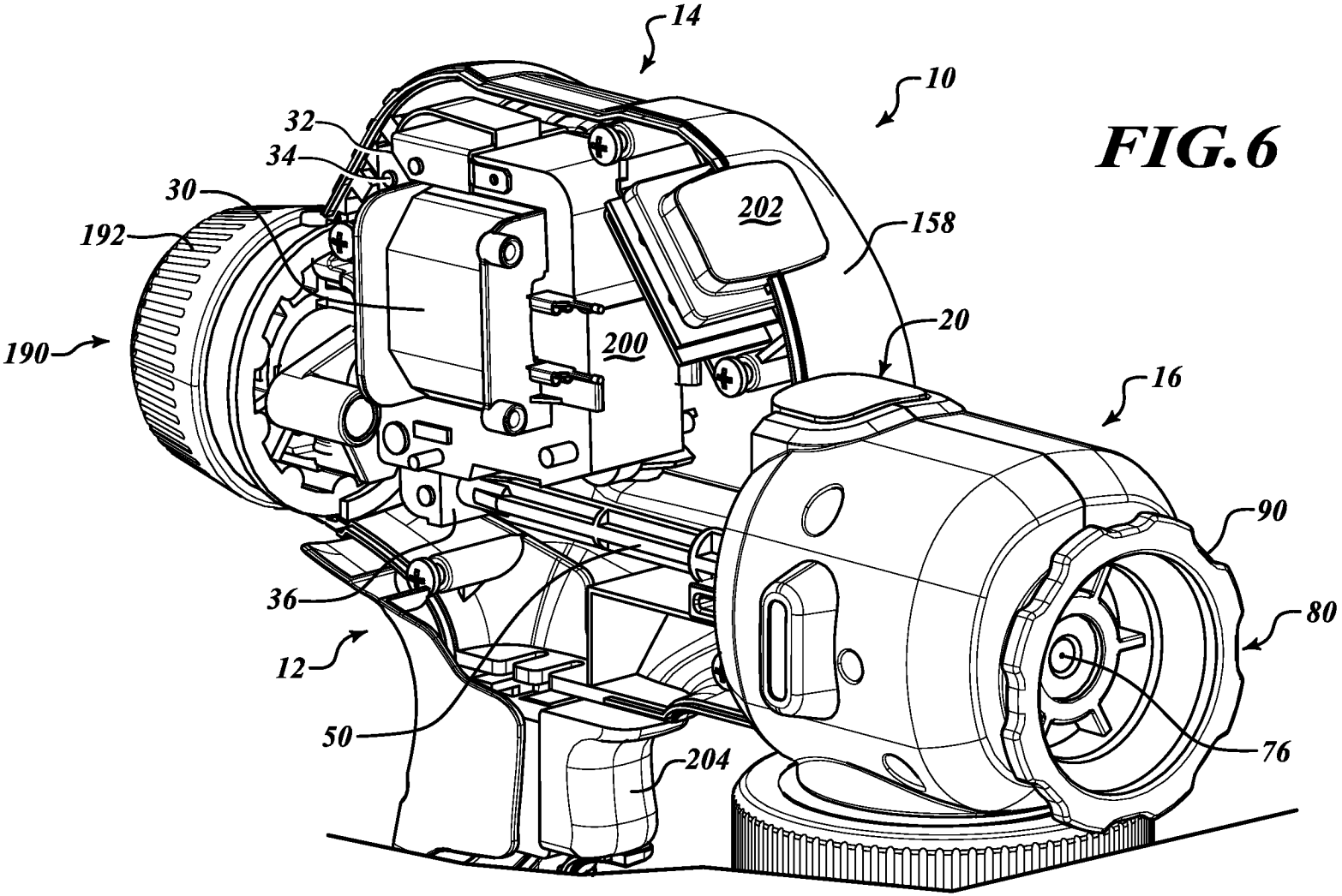
FIG. 6 is a partial perspective view of the sprayer of FIG. 1 illustrating the wet housing portion locked to the dry housing portion to connect the piston member with an engagement portion on an arm member constructed in accordance with the present teachings.

With reference to FIGS. 4 and 5, a protrusion 100 and a protrusion 102 can be connected to the chamber member 66. The protrusions 100, 102 can be on opposite sides of the chamber member 66. The protrusion 100 can have a leading edge 104, a trailing edge 106 and a tip 108. As such, the protrusion 100 can include a wing member 110 that can form at least a partial rectangular shape. The tip 108 of the protrusion 100 can include a post member 112. In this arrangement, the leading edge 104 can be longer than the trailing edge 106 and can terminate at the post member 112.

The protrusion 102 can have a similar structure and can have a leading edge 120, a trailing edge 122 and a tip 124. As such, the protrusion 102 can include a wing member 126 that can form at least a partial rectangular shape. The tip 124 of the protrusion 102 can include a post member 128. Similarly, the leading edge 120 can be longer than the trailing edge 122 and can terminate at the post member 128. The wing members 110, 126 can extend longitudinally in the same direction as the piston member 50. In this regard, the protrusions 100, 102 can engage with the channel member 40.

The channel member 40 can include a groove 130 and a groove 132. The grooves 130, 132 can be formed on opposite sides of the channel member 40 and can be configured to receive the protrusions 100, 102. The grooves 130, 132 can be formed at the receiving aperture 42 of the channel member 40. As the piston member 50 is inserted into the channel member 40, the grooves 130, 132 can receive the protrusions 100, 102. The leading edge 104 of the protrusion 100 can abut a stop 134 formed in the groove 130 opposite the receiving aperture 42. Similarly, the leading edge 120 can abut a stop 136 formed in the groove 132 opposite the receiving aperture 42. When the protrusions 100, 102 are held in the grooves 130, 132 and up against the stops 134, 136, the wet housing portion 16 can be in the proper position to be locked to the dry housing portion 14. Moreover, the tip portion 52 of the piston member 50 can be positioned to be in contact with the engagement portion 36 of the arm member 32.

The groove 130 can define a pair of walls 140 and the groove 132 can define a pair of walls 142 that can extend between the receiving aperture 42 and the stops 134, 136, respectively. The pair of walls 140 can hold the wing member 110 and the pair of walls 142 can hold the wing member 126. When the protrusions 100, 102 are secured in the grooves 130, 132, the complementary partial rectangular shapes can be configured to be shown to limit movement of the piston member 50 in the channel member 40 but for its reciprocating movement. By limiting the movement as described above, the tip portion 52 can be aligned with and engaged to the receiving portion of the arm member 32. The limiting of the movement can also be shown to reduce the motion of the wet housing portion 16 relative to the dry housing portion 14. Put another way, to properly align the tip portion 52 with the engagement portion 36, the user need only insert the piston member 50 into the channel member 40 so that the protrusions 100, 102 are accepted by the grooves 130, 132. It can also be shown that the vibration experienced by the wet housing portion 16 that can affect the pattern of the spray can be reduced or eliminated, when the protrusions 100, 102 are seated in the grooves 130, 132, respectively.

With reference to FIGS. 2, 3, 4, and 5, the dry housing portion 14 includes the catch member 20. In one example, the catch member 20 can include a clasp member 150 disposed between an elastic member 152 and a button member 154. The button member 154 can have a surface 156 that can extend out of and be accessible from an exterior 158 of the dry housing portion 14. A surface 160 of the button member 154 opposite the surface 156 can connect to a top portion 162 of the clasp member 150. The clasp member 150 can also include a first leg member 164 opposite a second leg member 166. The first leg member 164 can be disposed far enough from the second leg member 166 so that the clasp member 150 can be disposed over the channel member 40 in the dry housing portion 14.

With reference to FIG. 2, the first leg member 164 of the clasp member 150 can include a pocket 170 that is adjacent a ramp 172. The second leg member 166 can also include a pocket 174 that is adjacent a ramp 176. The elastic member 152 can be further compressed when the catch member 20 is pushed from the extended condition into the retracted condition. From the retracted condition, the elastic member 152 can extend and push the catch member 20 from the retracted condition into the extended condition. The catch member 20 can move along an axis 180 (FIGS. 2 and 3) between the extended and retracted conditions. With reference to FIGS. 2 and 3, the axis 180 can be disposed transverse to an axis 182 along which the piston member 50 can reciprocate in the longitudinal direction. In one example, the axes 180, 182 can be perpendicular.

With reference to FIGS. 2, 3, 9, 10, and 11, the pockets 170, 174 on the catch member 20 in the extended condition can hold the post members 112, 128 on the protrusions 100, 102, respectively, that extend from the chamber member 66. In doing so, the wet housing portion 16 can be locked to the dry housing portion 14 and the tip portion 52 of the piston member 50 can be held in contact with the engagement portion 36 on the arm member 32 in the dry housing portion 14.

Figure 10:
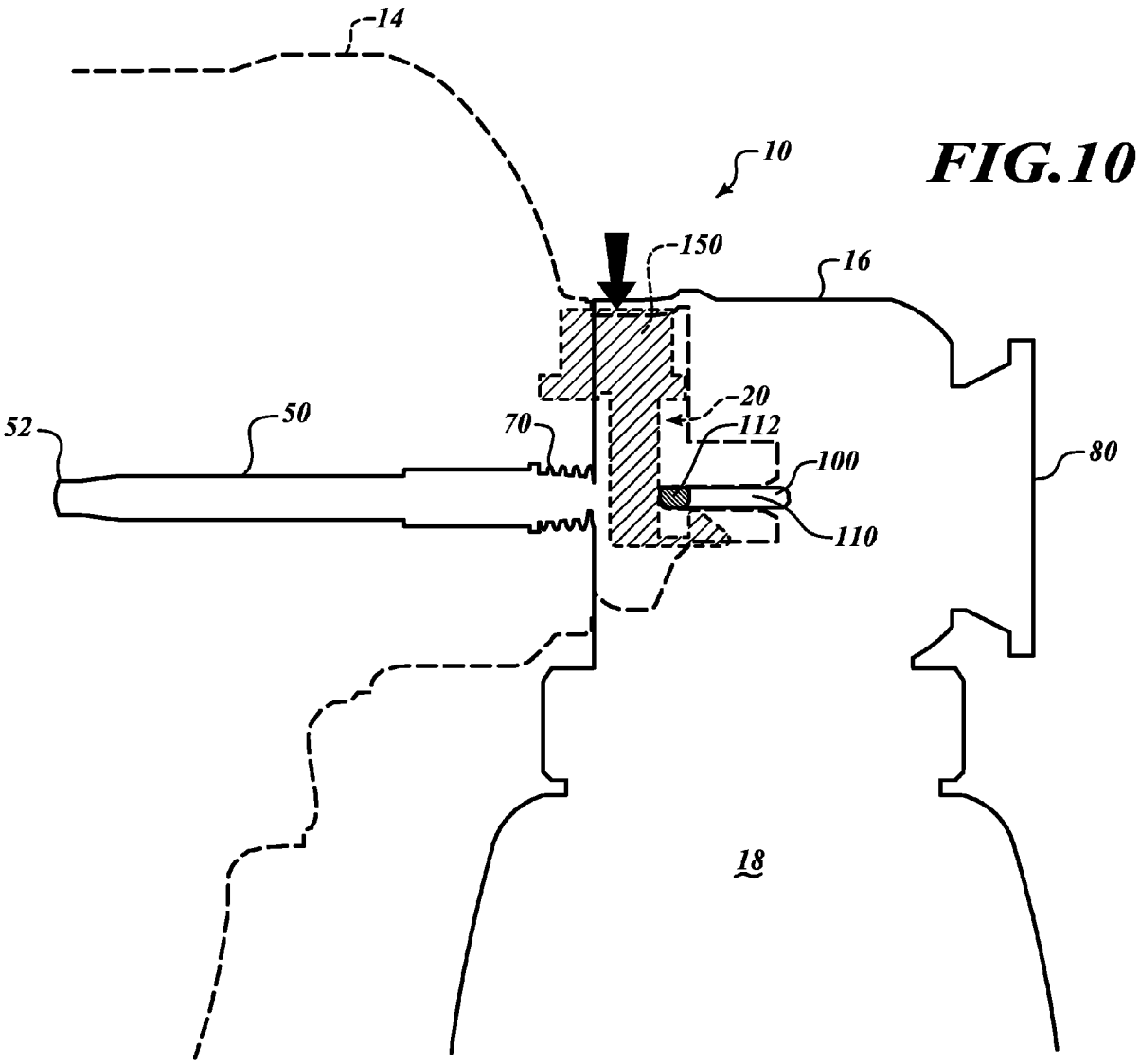
FIG. 10 is similar to FIG. 9 and shows the catch member in a retracted condition that permits the wet housing portion to be unlocked from the dry housing portion in accordance with the present teachings.

With reference to FIGS. 2, 3, and 10, the button member 154 can be pushed to drive the clasp member 150 toward the channel member 40 and into the retracted condition. As such, the elastic member 152 between the channel member 40 and the clasp member 150 can be compressed further and the legs 164, 166 of the clasp member 150 can travel downward and move the ramps 172, 176 of each leg member 164, 166 out of obstruction with the post members 112, 128 on each side of the chamber member 66. With the obstruction removed from the post members 112, 128, the elastic member 70 between the chamber member 66 and the piston member 50 can extend and increase the space between the chamber member 66 and the piston member 50, as shown in FIG. 11. This can result in the wet housing portion 16 being pushed away from the dry housing portion 14 to begin the process of disconnecting the wet housing portion 16 from the dry housing portion 14. In doing so, the piston member 50 can be withdrawn from the channel member 40 and the engagement between the wet housing portion 16 and the dry housing portion 14 can be broken. In this arrangement, the wet housing portion 16 and the reservoir body 18 can be cleaned and washed without exposing the dry housing portion 14 to such a cleaning process.

The wet housing portion 16 can be unlocked from the dry housing portion 14 by pressing the button member 154 perpendicular to the direction along which the wet housing portion 16 separates from the dry housing portion 14.

With reference to FIGS. 2, 3, 9, 10, and 11, the wet housing portion 16 can be connected to the dry housing portion 14, when the catch member 20 is in the extended condition. In this regard, the piston member 50 can be inserted into the channel member 40 and the wet housing portion 16 can be pushed against the dry housing portion 14. When the post members 112, 128 on the chamber member 66 encounter the ramps 172, 176 on the leg members 164, 166 of the catch member 20, the post members 112, 128 can drive the ramps 172, 176 downward, thus moving the catch member 20 from the extended condition to the retracted condition (or at least partially).

The wet housing portion 16 can be further pushed into locking engagement with the dry housing portion 14 and the post members 112, 128 on the chamber member 66 can move over the ramps 172, 176 and into the pockets 170, 174 formed on the leg members 164, 166. Once the post members 112, 128 on the chamber member 66 seat into the pockets 170, 174 on the leg members 164, 166 of the clasp member 150, the catch member 20 can move from the retracted condition back to the extended condition. In this position, the tip portion 52 of the piston member 50 can be held in contact with the engagement portion 36 and the solenoid motor 30 can cause the reciprocation of the piston member 50. The ramps 172, 176 can also be square shaped (i.e., not ramped), and therefore require that the user move the catch member 20 to the retracted condition to permit connection and locking of the wet housing portion 16 to the dry housing portion 14.

With reference to FIGS. 2, 3, and 4, it will be appreciated in light of the disclosure that the sprayer 10 need only be tipped on its side and a cap 184 can be removed to permit access to a cavity 186 defined by the reservoir body to fill or empty the reservoir body 18 as desired. The reservoir body 18 may be manufactured in various ways, including blow molding or a combination of injection molding and blow molding.

Additionally or alternatively, a connection bore 188*a* can be included on the dry housing portion 14 and a connection bore 188*b* can be included on the wet housing portion 16. The connection bores 188*a*, 188*b* can be pinned to lock the wet housing portion 16 to the dry housing portion 14.

With reference to FIGS. 1, 2, 7, and 8, a spray adjuster 190 can be configured to control the solenoid motor 30. The spray adjuster 190 can comprise a knob 192 that can be rotated into one of a multitude of positions as selected by the user of the sprayer 10. Moreover, a system of indicia can be employed to communicate to the user information concerning the placement of the knob 192. In a basic form, the system of indicia can include words or numbers that relate to the volume of paint that is dispensed when the sprayer 10 is operated and the knob 192 is in a particular position. For examples, a series of words (e.g.: very small, small, medium, large, extra large) or a series of numbers (e.g.: 1, 3, 7, 11, 19) could be employed.

As another example, the system of indicia can comprise a multitude of icons 194 that illustrate one or more tasks that could be performed satisfactorily when the knob 192 is placed in a specific position. The icons 194 can include a chair project 196*a*, a door project 196*b*, a picnic table project 196*c*, a shed door project 196*d*, and a gate project 196*e*, where the projects can require increasing paint flow from the sprayer 10, as the knob is rotated clockwise relative to FIG. 8. By way of this example, the gate project 196*e* can require the largest magnitude of paint flow relative to chair project 196*a*.

Figure 7:
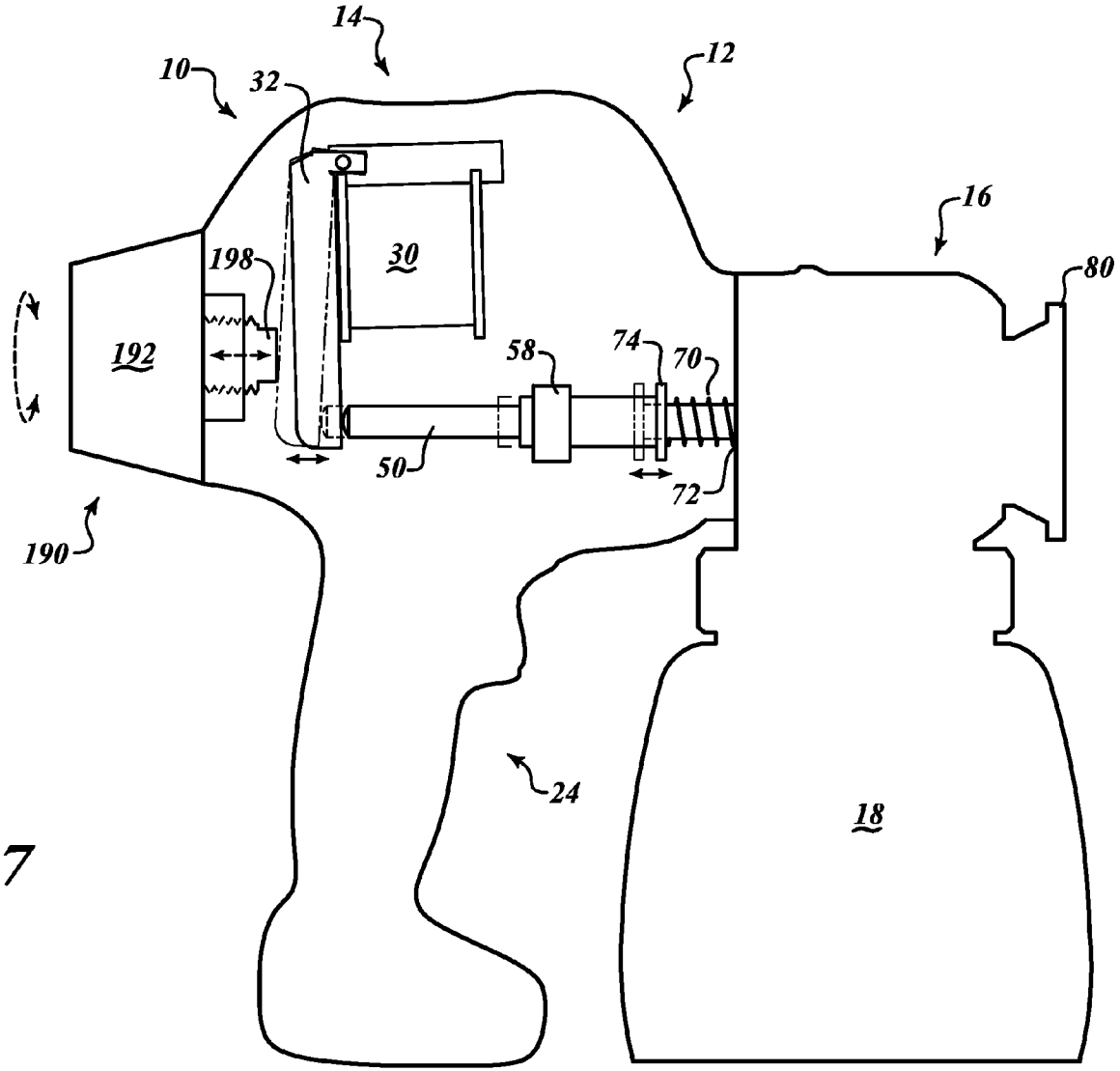
FIG. 7 is a diagram of the sprayer of FIG. 1 showing a knob of a spray adjuster that can adjust a position of a stopper to limit range of motion of the arm member imparted by the solenoid motor that in turn limits the motion of the piston member as it reciprocates in the channel member in accordance with the present teachings.
Figure 8:
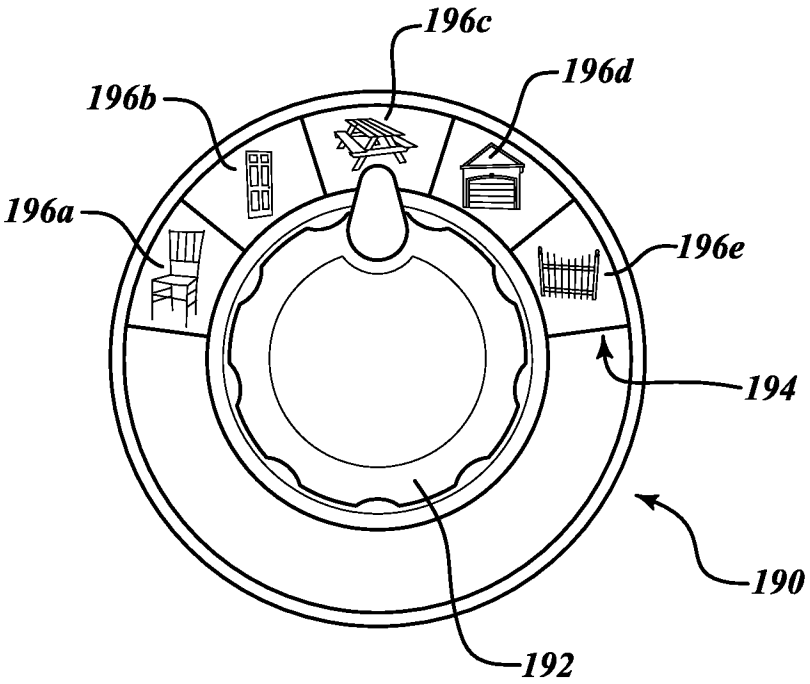
FIG. 8 is a diagram of an exemplary knob of a spray adjuster for the sprayer of FIG. 1 that can be rotated relative to task descriptive icons to limit paint flow for specific applications in accordance with the present teachings.

With reference to FIG. 7, a stopper member 198 can be configured to selectively retract into or extend from the knob 192, as the knob 192 is rotated relative to the tool housing 12. The stopper member 198 can be disposed within the tool housing 12 of the dry housing portion 14. The stopper member 198 can be in engagement with the arm member 32 upon which the solenoid motor 30 imparts a pivoting motion. In this regard, the pivoting motion of the arm member 32 can be limited by obstruction with the stopper member 198. As the knob 192 is rotated to a certain position that requires less volume of paint to be emitted from the sprayer 10 (e.g.: the door project 196*b*), the stopper member 198 can limit the pivoting motion of the arm member 32 relative to an application that requires relatively larger volumes of paint (e.g.: the gate project 196*e*) to be emitted from the sprayer 10. It will be appreciated in light of the disclosure that the spray adjuster 190 can mechanically limit (in contrast to electronically limiting) the amount of paint that the solenoid motor 30 causes the piston member 50 to pump from the reservoir body 18.

With reference to FIGS. 2, 3, 4, and 5, a control module 200 can be included in the dry housing portion 14. A switch 202 can be connected to the control module 200 and can be accessible on the exterior 158 of the tool housing 12. The user can use the switch 202 to limit the output of the solenoid motor 30. In doing so, the solenoid motor 30 can be switched, for example, between a low mode and a high mode. In this example, the rate at which the solenoid motor 30 reciprocates can be reduced to provide relatively less pumping action. A trigger 204 can be arranged in the tool housing 12 of the dry housing portion 14 near the handle 24. The trigger 204 can be electrically connected to the control module 200 and can be configured to move in an aperture 206 between an extended condition and a retracted condition. The trigger 204 in the retracted condition can actuate the solenoid motor 30.

The foregoing description of the exemplary aspects of the present teachings has been provided for purposes of illustration and description. Individual elements or features of a particular aspect of the present teachings are generally not limited to that particular aspect, but, where applicable, are interchangeable and can be used in other aspects, even if not specifically shown or described. The same may also be varied in many ways. Such variations are not to be regarded as a departure from the present teachings, and all such modifications are intended to be included within the scope of the present teachings.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to", "connected to," or "coupled to" another element or layer, it may be directly on, engaged, connected or coupled to the other element or layer, or intervening elements or layers may be present. In contrast, when an element is referred to as being "directly on," "directly engaged to", "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer, or section from another region, layer, or section. Terms such as "first," "second," and other numerical terms when used herein do not imply a sequence or order unless clearly indicated by the context. Thus, a first element, component, region, layer, or section discussed below could be termed a second element, component, region, layer, or section without departing from the aspects of the present teachings.

Spatially relative terms, such as "inner," "outer," "beneath," "below", "lower", "above", "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A sprayer comprising:

a tool having a first portion and a second portion, the second portion having a chamber member;

an arm member mounted for pivoting movement on the first portion;

a solenoid motor housed in the first portion, the solenoid motor configured to drive the arm member relative to the first portion;

a spray nozzle coupled in fluid communication with the chamber member;

a piston member received in the chamber member, the piston member having a tip portion that engages the arm member such that pivoting motion of the arm member relative to the first portion causes corresponding reciprocation of the piston member in the chamber member along a piston axis; and a catch member slidably mounted on the first portion for movement between a first position, in which the catch member locks the first and second portions to one another, and a second position that is spaced apart from the first position along a translation axis to permit the second portion to be separated from the first portion along the separation axis; and a user actuatable button which operates the catch member;

wherein the chamber member has an engagement portion for engaging with the catch member when the catch member locks the first and second portions to one another; and wherein the second portion has a second housing portion which surrounds the engagement portion.

2. The sprayer of claim 1, further comprising an elastic member that biases the catch member toward the first position.

3. The sprayer of claim 1, wherein one of the catch member and the second portion comprises a pocket and the other one of the catch member and the second portion defines a post member that is received into the pocket when the catch member couples the first and second portions together.

4. The sprayer of claim 3, wherein the other one of the catch member and the second portion further defines a protrusion that is slidably received into a groove formed in the one of the catch member and the second portion.

5. The sprayer of claim 4, wherein the post is formed on the protrusion.

6. The sprayer of claim 1, wherein the catch member is generally U-shaped.

7. The sprayer of claim 1, wherein the first portion defines a handle.

8. The sprayer of claim 1, wherein the translation axis is transverse to the separation axis.

9. The sprayer of claim 8, wherein the translation axis is perpendicular to the separation axis.

10. The sprayer of claim 1, wherein the sprayer further comprises a user actuatable button for operating the catch member;

wherein the user actuatable button is part of the first portion; and wherein the second housing portion includes a cut-out for receiving the user actuatable button when the catch member locks the first and second portions to one another.

11. The sprayer of claim 1, wherein the user actuatable button comprises a single button which is operable by a user to change the sprayer from a locked condition in which the first and second portions are locked to one another and a released condition in which second portion may be separated from the first portion along the separation axis.

12. The sprayer of claim 1, wherein the first portion has a channel member in which the piston is received when the first and second portion are locked to one another; and wherein the catch member extends over at least three sides of the channel member.

13. The sprayer of claim 1, further comprising an elastic member that biases the catch member toward the first position.

14. A sprayer comprising:

a tool having a first portion and a second portion, the first portion including a solenoid motor and a handle, the second portion including a spray nozzle and a chamber member;

an arm member mounted for pivoting movement on the first portion;

the solenoid motor housed in the first portion, the solenoid motor configured to drive the arm member relative to the first portion;

the spray nozzle coupled in fluid communication with the chamber member;

a piston member received in the chamber member, the piston member having a tip portion that engages the arm member such that pivoting motion of the arm member relative to the first housing portion causes corresponding reciprocation of the piston member in the chamber member along a piston axis; and a catch member slidably mounted on the first portion for movement between a first position and a second position;

wherein, when the catch member is in the first position, the first and second portions are locked to one another and when the catch member is in the second position that is spaced apart from the first position along a translation axis, the sprayer is in a released condition such that the second portion is separable from the first portion along the separation axis;

wherein the catch member can be moved from the first position to the second position by actuation of a single user operable button;

wherein the first portion has a channel member in which the piston is received when the first and second portion are locked to one another; and wherein the catch member extends over at least three sides of the channel member.

15. The sprayer of claim 14, wherein the chamber member has an engagement portion for engaging with the catch member when the catch member locks the first and second portions to one another; and wherein the second portion has a second housing portion which surrounds the engagement portion.

16. The sprayer of claim 15, wherein the user actuatable button is part of the first portion; and wherein the second housing portion includes a cut-out for receiving the user actuatable button when the catch member locks the first and second portions to one another.

17. The sprayer of claim 15, further comprising an elastic member that biases the catch member toward the first position.

* * * * *